United States Patent [19]

Wilkinson

[11] Patent Number: 4,991,400

[45] Date of Patent: Feb. 12, 1991

[54] ENGINE DRIVEN HEAT PUMP WITH AUXILIARY GENERATOR

[75] Inventor: William H. Wilkinson, Columbus, Ohio

[73] Assignee: Gas Research Institute, Chicago, Ill.

[21] Appl. No.: 483,676

[22] Filed: Feb. 23, 1990

[51] Int. Cl.[5] ..... F25B 49/00

[52] U.S. Cl. ..... 62/228.4; 62/323.4; 62/323.3; 62/243

[58] Field of Search ..... 62/323.4, 323.3, 243, 62/323.1, 228.1, 228.4, 230; 417/364

[56] References Cited

U.S. PATENT DOCUMENTS 2,889,691 6/1959 Schjolin ..... 62/323.4

3,545,222 12/1970 Petranek ..... 62/323.3

*Primary Examiner*—Albert J. Makay

*Assistant Examiner*—John Sollecito

*Attorney, Agent, or Firm*—Watkins, Dunbar & Pollick

[57] ABSTRACT

The heating and cooling of structures is accomplished by driving a compressor of an air conditioning system with an internal combustion engine. The engine also drives an electrical generator to provide electrical power to the various components of the heating and cooling subsystem such as fans, motors, pumps, and controls. A constantly variable transmission apparatus and a differential power transmission are cooperatively connected to the engine to provide substantially constant speed operation of the generator.

9 Claims, 2 Drawing Sheets

ENGINE DRIVEN HEAT PUMP WITH AUXILIARY GENERATOR

FIELD OF THE INVENTION

This invention relates to engine driven heat pumps systems which provide for the auxiliary generation of electrical power for operation of other electrical components of the system. More particularly, it relates to those systems which are driven by internal combustion engines wherein the engine drives an electrical generator that generates auxiliary power for the motors which drive the fans and pumps of the system.

BACKGROUND OF THE INVENTION

This invention is directed primarily to heat pump systems which are applied to heating and air conditioning loads of the environment in the living spaces of buildings. As used herein, the term air conditioning means the adjustment of the temperature and humidity in the living space to selected comfortable norms when the outside environment and particularly the ambient temperature, is either too high or too low for comfort. However, many of the objectives and concepts of this invention also have application to other types of thermal loads. Therefore the term "load" as used herein while specifically in the context of air conditioning, may be interpreted broadly to apply to other thermal loads by those familiar with heating and cooling technology.

It is well recognized that air conditioning and heat pumping thermal systems require a heat source from which the heat load may be transferred in the heating mode. In recent time and particularly in connection with air conditioning activity, efforts have been directed to the convenient economical use of ambient outside air as the heat sink for the cooling load, and also as the heat source in the heating or heat pumping mode.

Most heat pumps in commercial use, and particularly with respect to a residential application, are of the vapor compression type wherein the refrigerant gas, usually freon R-22, is compressed, condensed, and evaporated to lower pressure in an evaporator that absorbs heat. In the cooling mode of operation the compressed vapor condensing means (an outdoor heat exchanger) is located in contact with the ambient outside air where the heat of compression is transferred to the ambient air. The condensed refrigerant is expanded or evaporated in a means for exchanging heat with the heat load of a living space.

In the heating mode, the system is reversed and the indoor heat exchanger receives the compressed hot gas which is condensed by heat exchange with the heat load of the living space, after which the gas is expanded in heat exchange with the ambient air, thereby absorbing heat from the ambient outside air. By this means heat is "pumped" from the ambient outside air into the living space.

In these systems mechanical energy is required to compress the refrigerant vapor. In the most common typical and conventional system refrigerant vapor is compressed in a rotating or reciprocating compressor which is frequently driven by an electric motor. In those systems an external source of electrical power input is required.

In other circumstances, the compressor is driven by an internal combustion engine or other form of motive power, but inside and outside fans and the engine starter are driven by electric motors connected to an outside source of power. Such engine driven systems can be more efficient, and in them, it is mechanically desirable to eliminate the need for a source of external electrical power. This is accomplished by connecting and driving an electrical generator as an auxiliary source of electrical energy for the various auxiliary components of the system. Such components may include motors to start the engine and drive the fans, to move the air, as well as pumps to move other fluids through the system.

The co-generation of electrical energy in these systems is attendant with various problems such as, maintaining constant electrical output when the mechanical motive power varies according to the refrigeration and/or heat load on the system.

In these engine driven heat pump systems with auxiliary generators, it has been found most efficient that the generator be of the induction motor type and that the output for the auxiliary components be alternating current, typically 60 cycle, as commonly provided from other sources. In order to provide 60 cycle alternating current power, it is necessary that the generator be operated at substantially constant speed.

It will be well recognized that the heating and cooling load in air conditioning systems will vary over a wide range of conditions.

At one heating extreme the heat load will be very high when the ambient outside temperatures are very low. On the other hand, the cooling load will be very high when the outside ambient temperatures are elevated to a high temperature.

An additional problem with the operation of heat pumping systems of the "air source" type is that when the outside temperature is very low it is difficult to efficiently operate the refrigerant gas compressor as the refrigerant gas is very thin at low temperature and therefore the load on the compressor is drastically reduced, in many cases to the point where auxiliary heat is required.

For these reasons when the compressor is driven by an internal combustion engine the load on the engine will vary dramatically with the compressor load. Consequently, engine throttle control and speed control are an important factor.

The combination of the various variables in the operation of the engine driven heat pump system are further compounded when the system is used to drive an auxiliary generator that is desirably operated at constant speed.

This invention is directed to an apparatus providing for the interconnection and cooperation of the various components of the system in a manner to provide optimum solution to the problems set forth above.

In the past others have directed their attention to some of the facets and requirements in providing an efficient system.

For instance, U.S. Pat. No. 3,691,784—Ruff et al. discloses a variable capacity mechanical refrigeration system for heat pump or cooling operation with a variable speed centrifugal compressor motor drive that uses an electronic frequency conversion apparatus which is sensitive to and controlled by discharge or suction pressure of the compressor. In this patent, the compressor is driven by an electric motor of the squirrel cage induction type.

More pertinently, U.S. Pat. No. 3,559,724—W. H. Wilkinson, who is also the inventor of this invention, discusses a means of controlling the speed of the compressor output by means of a planetary differential as a means for adjusting the engine shaft power split between the generator and the compressor in response to changing conditions at the evaporator, i.e. at the load, by using a hydrostatic variable speed device between the engine and the compressor. In this previous invention, the compressor speed is directly controlled by the hydrostatic device while the differential planetary limits the amount of power actually transmitted through the hydrostatic device.

Whereas a hydrostatic variable speed device can stall one output (the compressor) as it maintains the generator at a controlled speed, a hydrostatic device is too expensive and requires too careful maintenance for residential and small commercial applications. Traction type continuously variable transmissions (CVT) can be reliable and inexpensive but cannot "stall" one output (infinite gear reduction). Belt driven CVT's generally provide continuous ratios from about 1:2 speed increase to 2:1 speed decrease. This invention involves locating the CVT between the driving unit (the engine) and the generator so that the compressor output can be indirectly defined as a difference which can go to zero. This unique CVT location allows a traction type CVT to provide control functions similar to those of the hydrostatic system, but without the disadvantages of a hydraulic system.

SUMMARY OF THE INVENTION DISCLOSURE

In summary, this invention is a motive drive system for heating and cooling apparatus, which includes a vapor compressor means and an electric power generation means for driving system auxiliaries. The system includes an internal combustion engine in rotatively driving connection to a differential planetary transmission means and also directly to an electric generator means. The direct connection means from the engine to the electrical generation means includes a first output means of the differential planetary power transmission apparatus together with a constantly variable transmission means. The engine is also connected to the compressor means through the differential transmission means by a second output of the differential transmission means.

A governor is provided on the rotative driving connection to the generator, which operates to control the throttle and speed of the engine, so that regardless of the transmission ratio of the constantly variable transmission means, substantially constant rotative speed and electrical frequency output of the generator can be provided. Independently the demand established by the comfort conditioning load controls the transmission ratio of the CVT which indirectly controls the compressor speed.

In the foregoing, and otherwise, advantages of the invention will become apparent from the following disclosure in which the preferred embodiment of the invention is described in detail and illustrated in the accompanying drawings. It is contemplated that variations in procedure, structural features and arrangement of parts may appear to those skilled in the art without departing from the scope or sacrificing any of the advantages of the invention.

Figure 1:
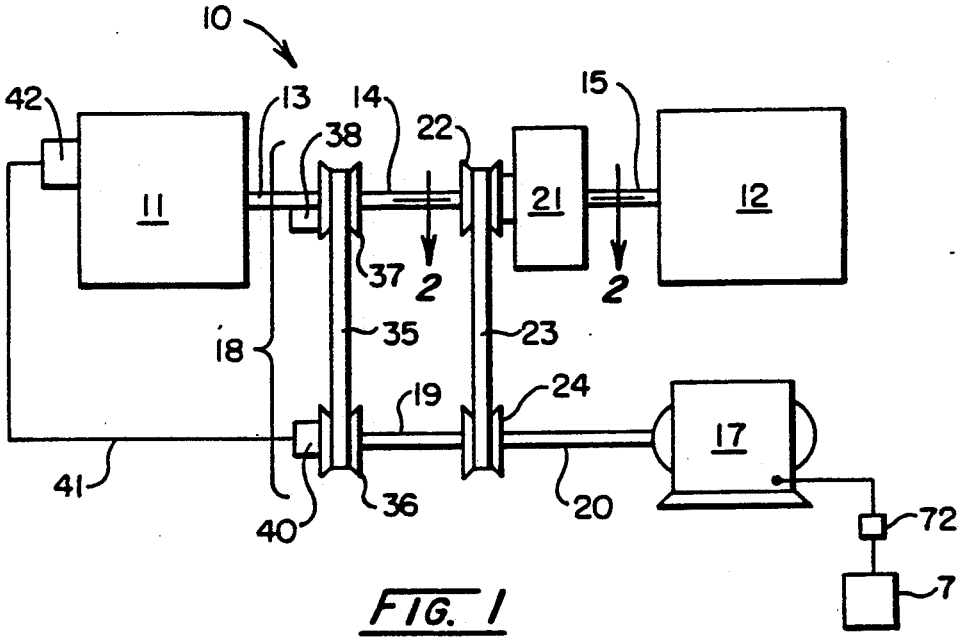
FIG. 1 is a schematic diagram of the motive drive system of this invention showing the relationship of the components.

In the following description of the preferred embodiment of the invention, which is illustrated in the drawings, specific terminology will be used for the sake of clarity. However, it is not intended that the invention be limited to the specific terms so selected or the system so shown and it is to be understood that each specific term includes all technical equivalents which operate in a similar manner to accomplish a similar purpose.

DETAILED DESCRIPTION OF AN EMBODIMENT OF THE BEST MODE FOR CARRYING OUT THE INVENTION

Referring to FIG. 1, a motive drive system 10 of this invention is schematically shown disclosing an internal combustion engine in rotatively driving connection to a compressor 12 through shaft means 13, 14 and 15. Shafts 13 and 14 are connected together through pulley 37 while shafts 14 and 15 are coupled through the differential transmission 21. The engine 11 is in rotatively driving connection to an electric generator means 17 through a continuously variable transmission means 18, and shafts 19 and 20. Shafts 19 and 20 are connected together through pulley 24. The differential planetary transmission 21 is in driving connection between the shafts 14 and 15 and driving components 22, 23 and 24 operatively connected to shafts 19 and 20.

Figure 2:
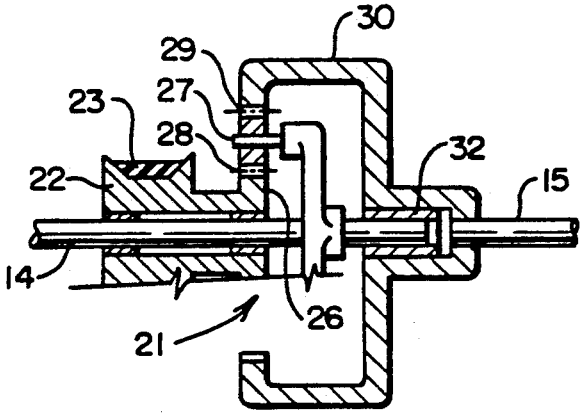
FIG. 2 is a partial sectional elevation view of the differential planetary transmission means of this invention, on the line 2—2 of FIG. 1.

Referring to FIG. 2, the differential planetary transmission means 21 includes a pinion gear 26 at the end of shaft 14 in meshing engagement with planet gear 27 through teeth 28 and 29 which also mesh with internally toothed ring gear 30. Pinion gear 26 includes a power transmission component 22, shown in a pulley configuration, that is adapted to receive a transmission means such as a flexible belt 23. The output shaft 15 rotates in a bearing 32. At the internal end of shaft 14, a crank 33 is in rotative supporting position with respect to the planet gear 27.

A constantly variable transmission (CVT) 18, as seen in FIG. 1 includes a transmission belt 35 between variable pulleys 36 and 37. The continuously variable transmission 18 is of conventional construction and will be readily understood, by those skilled in the art, to provide a means for driving at continuously varying transmission ratios by means of varying the spacing between the pulley flanges in inversely proportional increments between the pulley 36 at one end and the pulley 37 at the opposite end. In the usual drive of this type a means is provided to move the pulley flanges at one end closer, or further apart, and through the rotation of the pulleys and driving belt 35 the flanges of the pulley at the opposite end are caused to move closer together or farther apart under the influence of springs (not shown) which are biased to close the distance between the flanges on the pulley 36. An actuating mechanism to accomplish the transmission ratio changes is schematically shown in a housing 38 juxtaposed to the pulley 37.

Referring again to FIG. a battery is connected through a rectifier and switch means 72 to the generator 17.

Not shown in the schematic presentation of FIG. 1 and 2 are various conventional supporting structures and housings that will be readily apparent to those conversant with the art and mechanisms of this kind. A sensor 40 is operatively positioned on shaft 19 to sense the speed of shaft 19 and connected electrically, or otherwise, by a conduit means 41 to a throttle actuator and control means 42 on the engine 11 to maintain the desired speed of the generator fixedly rotating with shaft 19.

Figure 3:
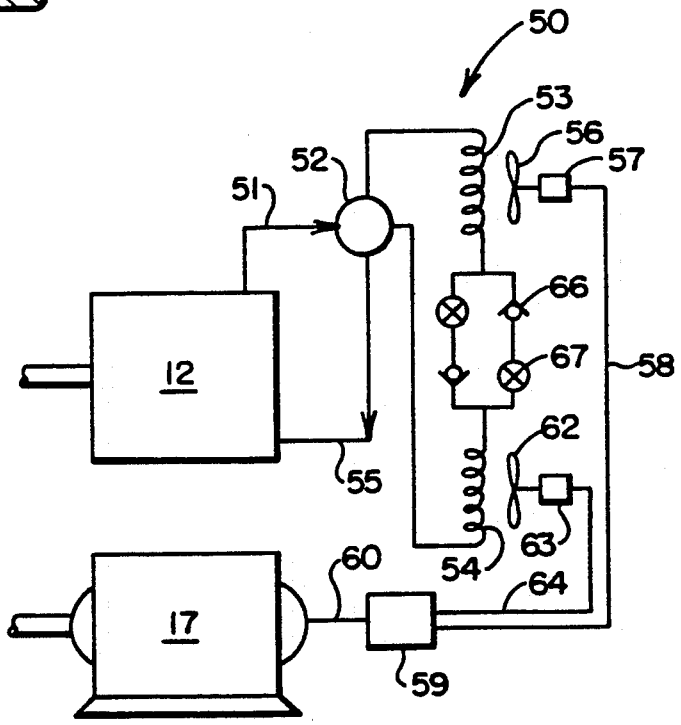
FIG. 3 is a schematic view of the heating and cooling subsystem of this invention, as it is connected to the components of the system.

Referring to FIG. 3, compressor 12 is connected to the heating and cooling subsystem 50 by discharge line 51 which conveys compressed gas through a four-way valve 52, that may be alternatively connected to either an outdoor coil 53 or an indoor coil 54. Low pressure refrigerant vapor is returned to the compressor through suction line 55. The fan 56 is driven by an electric motor 57 by means of a connection 58, to the control unit 59, which is connected by an electrical line 60 to the generator 17. In a similar construction, a fan 62 is driven by an electric motor 63, which is connected through a line 64 to the controller 59, and to the generator 17 through the electrical line 60.

In the cooling mode the four-way valve 52 is set to convey the hotter compressed vapor to the outdoor coil 53 which is operating as a condenser. The electric motor 57 moves the fan 56 to convey ambient outdoor air across the coil 53, cooling and condensing the refrigerant vapor after which it passes through a check valve 66 and expansion valve 67 to the indoor coil 54, where the refrigerant liquid is vaporized by extracting heat from the air of the indoor air conditioned space. The air of the indoor space is induced to pass across the coil 54 by the fan 62, which is driven by the motor 63, through controller 59, that operates to turn the fans on and off in accordance with the requirements and thermostatic control of the system as required by indoor and outdoor temperatures.

In the heating mode the valve 52 is turned to direct the hot discharge gas through the indoor coil, which is operating as a condenser, and through a check valve 68 and expansion valve 69 to the outdoor coil 53 which is operating as an evaporator. From coil 53, the cooler low pressure refrigerant is conveyed through the valve 52 and suction line 55 to the compressor 12.

In general, in the operation of the system, the engine 11 provides motive power to drive both the compressor 12 and the generator 17 through the differential planetary transmission 21, and the engine 11 also provides motive power to drive the generator 17 through the constantly variable transmission 18.

Generator means 17 is preferably of the alternating current (AC type), and is constructed to operate with relatively constant speed to provide approximately 60 hertz AC. For the operation of the various electrical components of the system, a relatively close adherence to the 60 cycle frequency is important, because the performance of the electrical components deteriorates as the frequency varies from the design specifications.

In view of the substantially constant speed requirement of the generator 17, the connecting shaft means 19 and 20 should rotate at constant speed, normally about 1800 rpm.

If the constantly variable transmission is set to the ratio of 1:1 the engine speed requirement is typically the same for the engine i.e., 1800 rpm.

Because the engine is in rotative driving connection to the compressor, the speed of the engine would tend to decrease with an increasing load on the compressor resulting from increased cooling or heating load on the subsystem 50. This tendency in the system for the engine 11 to slow as the compressor is loaded would vary with changes in the compressor load, with the consequence that the generator would be undesirably slowed and subject to speed reduction and variation.

In the operation of the system of this invention, the speed sensor 40 provides a signal to the throttle control 42 responsively to changes in the generator shaft speed. The throttle of the engine is adjusted to compensate, either feeding more fuel when the load on the compressor increases or feeding less fuel when the load on the compressor decreases. Nevertheless, while the system is responding to changes in load on the compressor, the control function originates by sensing the deviations from standard speed of the generator shaft.

In order that the compressor may be controlled to operate at different and more optimum speed and power settings in response to the load requirements of the comfort conditioning system while still maintaining the generator speed constant, the variable transmission 18 moves to change the drive ratio between the engine and the generator which indirectly changes the compressor speed.

The differential planetary transmission 21 connected between the compressor 12, the generator 17, and the engine 11 adjusts to the changing torque requirements as the speed of the shaft 13, 14, 15 varies from the speed of the shaft 19, 22 under the influence of the constantly variable transmission 18. By the appropriate selection of the number of teeth between the pinion gear 26, planet gear 27 and ring gear 30, the torque provided to the compressor can be selected in an appropriate ratio for the power and speed of the engine. Once selected, the ratios of these torques is a fixed characteristic of the design.

By way of example, by the selection of a CVT with a total range of 2:3 speed increase to 2:1 speed decrease, connected with a differential planetary transmission with a gear ratio of 3:1 (gearing train value magnitude between ring gear 30 and pinion 26), the system may be operated with the generator rotating at the standard speed of 1800 rpm and the engine idling at a speed of 900 rpm and the compressor rotation of substantially zero. This is an advantage where there is no load on the compressor because the engine would require minimum fuel consumption to provide output only from the generator.

At the opposite end of the spectrum, when maximum heating or cooling loads are placed upon the system, the constantly variable transmission 18 is adjusted to provide increasing speed and torque to the compressor and the throttle on the engine is opened to gradually, but relatively quickly, bring the engine speed and torque up to that required to carry the load and maintain the generator at its controlled (constant) speed. The usual design load would occur when the engine is at 2700 rpm, the compressor at 2400 rpm, and the generator at 1800 rpm.

Figure 4:
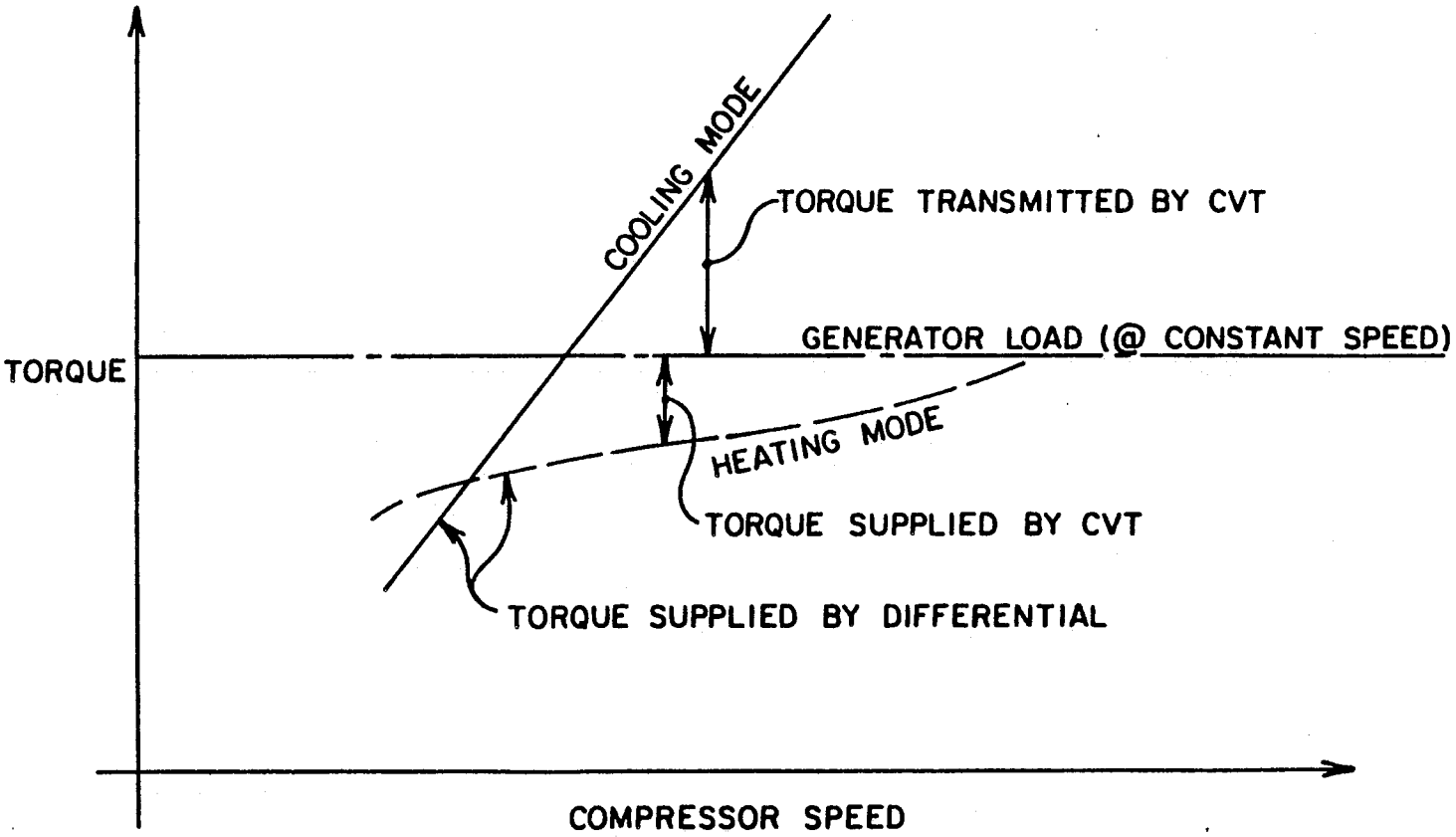
FIG. 4 is a graphic presentation of typical Power/-Torque Transmission vs. Compressor Speed in the operation of the system of this invention.

Referring to FIG. 4 it will be seen that as the compressor speed increases in the cooling mode, the torque at the generator shaft supplied by the differential increases. At the lowest speeds, it is less than needed by the generator so the extra power is supplied by the CVT. At an intermediate speed, the power supplied by the differential matches that needed by the generator and no power is actually transferred by the CVT. As the speed increases further, more power than needed is transmitted to the generator shaft and the CVT returns the excess to the engine shaft. On the other hand, during the heating mode a lessor amount of torque is provided at the generator shaft by the differential at all speeds and the CVT supplies the extra. As shown on FIG. 4, this differencing process limits the power actually transmitted by the CVT, allowing its size to be relatively quite small.

Typically, a 3:1 speed range for the engine would correspond to a full (0-max.) speed range for the compressor. The necessary 3:1 speed adjustment ratio is easily obtainable from the simplest of traction CVT's.

FIG. 4 illustrates these processes that reduce the CVT capacity to a small fraction of the engine power. If the auxiliary load is unchanged during operation, the torque loading demand at the constant-speed auxiliary shafts 19 and 20 would be constant regardless of compressor speed. A differential planetary, by definition, will create torques at its two output shafts at a fixed ratio to one another. Consequently, the variation in compressor torque will be reflected back to the auxiliary shaft, as illustrated, with different available driving-torque curves for the heating and cooling seasons.

During the heating season, the reflected torque available from the differential 21 to drive the generator is less than the demand, so the CVT supplies the difference to the generator—roughly $\frac{1}{4}$ the power. During the cooling season, the reflected torque is less than the demand during the mild weather, but more than needed during the hottest weather. In this latter mode, the CVT returns this excess back to the engine shaft at a power level on the order of one third ($\frac{1}{3}$) of the generator power demand. If generator power is about one third ($\frac{1}{3}$) the power demand of the compressor, the CVT power level is less than an order-of-magnitude smaller than the engine power. This reduced CVT size provides a favorable effect on equipment cost.

A still further advantage of the system is found in the connection of the generator to the battery 71 through the rectifier and switch 72. By this means the normal operation of the generator will keep the battery charged. Nevertheless, in the event that the engine shall have been turned off or stalled and there is a requirement to start the engine, starting can be accomplished by means of operating the generator as a starting motor with power from the battery. When the engine has started, the engine can be brought to the proper speed under the load conditions to bring the generator to its standard operating conditions.

A still further advantage of this invention is that by appropriate additions to the engine control system, the controlled speed of the generator can be increased by an amount of about plus or minus five percent to reduce or increase speed of the fans 56 and/or 62. This increases the efficiency of the subsystem 50, should this be desired because of extreme outside ambient operating weather conditions.

This will occur when the speed of the generator 17 is changed to produce an alternating current of 55 hz whereby the speed of the motors will be decreased by about 5%. On the other hand, if the speed of the generator 17 is increased to provide an output frequency of about 65 hz, the speed of the motors 57 and 63 will be increased by about 5%. As stated above, this can have advantages in the operation of the heating and cooling subsystem 50.

A still further advantage of this invention is that a small engine overspeed in the heating mode can cause a larger proportional increase in compressor speed so that increased heating delivery can be obtained by limited, low engine torque overspeeds when the ambient is unusually cold. An 11 percent (11%) engine overspeed (from 2200 rpm to 3000 rpm) would cause an 18 percent (18%) increase in compressor speed (from 2400 rpm to 2800 rpm, for example).

Although a preferred embodiment of the invention has been herein described, it will be understood that various changes and modifications in the illustrated described structure can be effected without departure from the basic principles that underlie the invention. Changes and modifications of this type are therefore deemed to be circumscribed by the spirit and scope of the invention defined by the appended claims or by a reasonable equivalence thereof.

I claim:

1. A motive drive system, for heating and cooling apparatus having vapor compressor means, comprising:

(a) an internal combustion engine means in rotating driving connection to the compressor means, and to an electric generator means, and providing motive power for the system;

(b) with the driving connection to the compressor means including: an input and an output means of a differential planetary power transmission means;

(c) with the driving connection to the electric generator means including: a continuously variable transmission means and a component of the differential planetary power transmission means connected to the driving connection to the compressor means;

(d) a governor means for sensing the rotational speed of the driving connection to the generator means and controlling the throttle and speed of the engine means, to provide substantially constant rotative speed and electrical frequency output of the generator means without respect to the speed, load, or torque of the compressor means, and (e) control means for the continuously variable transmission means to control the speed of the compressor means in response to the need for comfort conditioning.

2. A system according to claim 1 wherein the differential planetary transmission means includes:

(i) a first pinion gear means fixedly attached to the component of the differential planetary transmission means, (ii) a second planetary gear means engaging the first pinion gear means, while supported by an offset crank arm attached to the connecting means to the engine to provide planetary motion; and (iii) a ring gear rotatably supported on the connecting means to the compressor means and in engagement with the planet gear means.

3. A system according to claim 1 wherein the compressor is operatively connected to a cooling and heat pumping subsystem having components including: at least one coil means having airflow across the surfaces thereof that is induced by a fan powered by an electric motor which is connected to the generator.

4. A system according to claim 3 wherein switch means is provided to operate the generator as a motor from the stored energy in the battery to start the engine.

5. A system according to claim 1 wherein the ratio of transmission between the continuously variable transmission means and the differential planetary transmission means is variable to a ratio where the compression means operates at substantially zero speed and the generator means operates at substantially constant speed for maximum electrical system efficiency.

6. A system according to claim 1 wherein the generator means is connected to a battery and maintains the charge on the battery.

7. A system according to claim 2 wherein the control means is operable to adjust the rotational speeds of the generator to speeds selected to operate the fan means at speeds that are optimum for the heating or cooling load on the subsystem.

8. A motive drive system, for heating and cooling apparatus having vapor compressor means, comprising:

(a) an internal combustion engine means in rotating driving connection to the compressor means, and to an electric generator means, and providing motive power for the system;

(b) with the driving connection to the compressor means including:

an input and an output means of a differential planetary power transmission means;

(c) with the driving connection to the electric generator means including: a multiple pulley constantly variable transmission means and a component of the differential planetary power transmission means connected to the driving connection to the compressor means; and (d) a governor means for sensing the rotational speed of the driving connection to the generator means and controlling the throttle and speed of the engine means, to provide substantially constant rotative speed and electrical frequency output of the generator means without respect to the speed, load, or torque of the compressor means, and (e) control means for the continuously variable transmission means to control the speed of the compressor means in response to the need for comfort conditioning.

9. A system according to claim 8 wherein the constantly variable transmission means comprises a flexible endless belt in frictional engagement with a pair of flanges of first and second pulleys, and the first pulley is controlled to provide varying space between the flanges of the pulleys to vary the distance from the center of the pulley at which the driving belt member engages the flanges of the pulley, and the second pulley includes means for varying the spacing between the flanges of the pulley as influenced by the tension in the driving belt to vary the distance from the center of rotation of the pulley shaft and as urged by resilient means between the flanges of the second pulley.

* * * * *